US006334236B1

(12) United States Patent
Kalliomaki

(10) Patent No.: US 6,334,236 B1
(45) Date of Patent: Jan. 1, 2002

(54) VEHICLE DOOR PROP CLIP FOR A VEHICLE HINGE WITH SPLIT PINS

(75) Inventor: Eric Kalliomaki, Greenbank (CA)

(73) Assignee: Multimatic Inc., Ontario (CA)

( * ) Notice: Subject to any disclaimer, the term of this patent is extended or adjusted under 35 U.S.C. 154(b) by 0 days.

(21) Appl. No.: 09/466,878

(22) Filed: Dec. 20, 1999

Related U.S. Application Data

(60) Provisional application No. 60/113,179, filed on Dec. 21, 1998.

(51) Int. Cl.[7] ..... E05D 11/10
(52) U.S. Cl. ..... 16/334; 16/83
(58) Field of Search ..... 16/82, 86 A, 86 B, 16/83, 374

(56) References Cited

U.S. PATENT DOCUMENTS 2,201,594 A * 5/1940 Sitts ..... 292/76
3,621,508 A * 11/1971 DiNoia et al. ..... 16/180
3,911,529 A * 10/1975 Pringle ..... 16/142
4,891,862 A * 1/1990 Holan ..... 16/278
4,932,101 A * 6/1990 Lualdi ..... 16/255
5,577,295 A 11/1996 Papke et al. ..... 16/254
5,692,264 A * 12/1997 van der Steur ..... 16/82
5,924,170 A * 7/1999 Papke et al. ..... 16/321
6,108,866 A * 8/2000 Waynick, Jr. ..... 16/82

* cited by examiner

*Primary Examiner*—Lynne H. Browne
*Assistant Examiner*—John B. Walsh
(74) *Attorney, Agent, or Firm*—Borden Ladner Gervais; Terry Kramer

(57) ABSTRACT

A vehicle door hinge-mounted prop clip for a vehicle hinge with split pins, comprises first and second interference lobes defining a undulating circumferential edge, said interference lobes being adapted to sequentially releasably contact a portion of the hinge as the door is rotated about first and second axial hinge pins from a closed position to an open position, said contact releasably compressing said interference lobes severally or simultaneously and generating sufficient frictional resistance to releasably hold the door in a partially or fully open position.

7 Claims, 5 Drawing Sheets

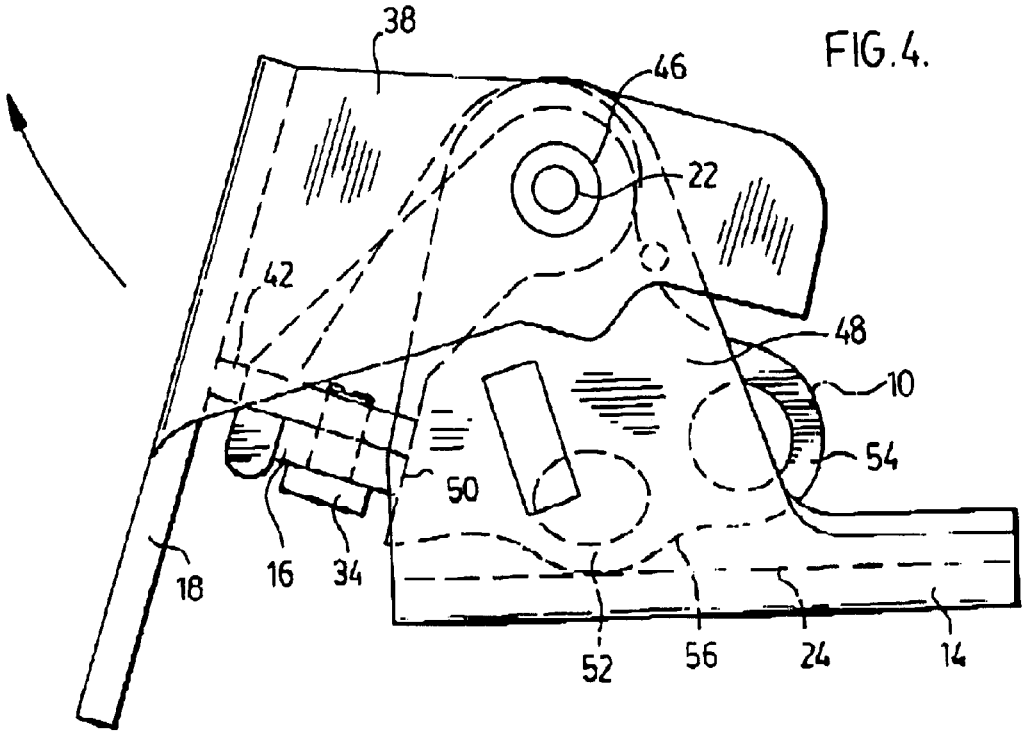
FIG. 4.
FIG. 3.
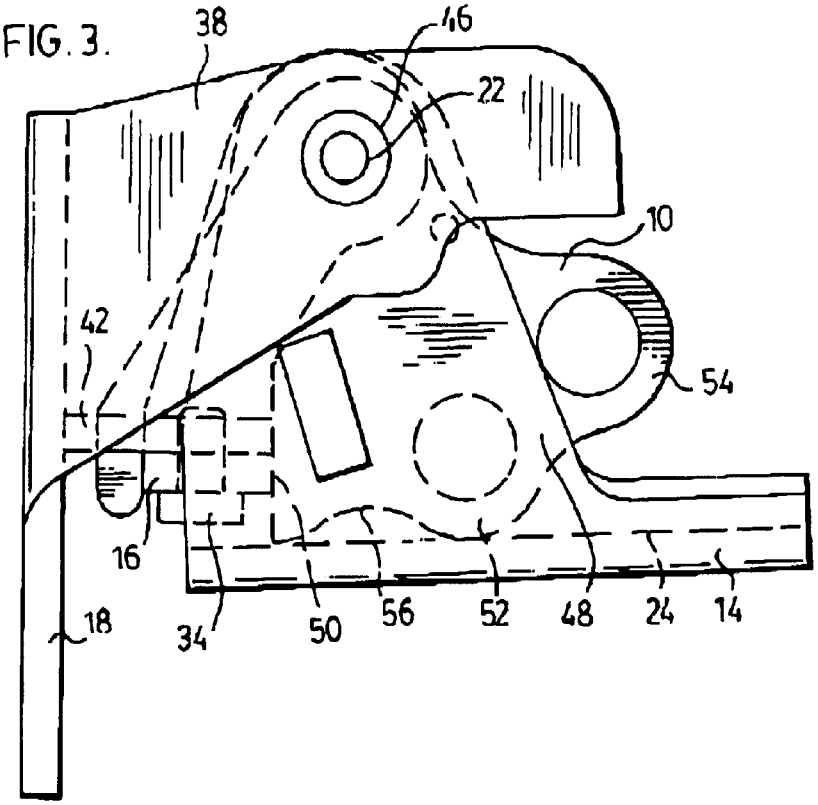

VEHICLE DOOR PROP CLIP FOR A VEHICLE HINGE WITH SPLIT PINS

This application claims benefit of provisional application Ser. No. 60/113,179, filed Dec. 21, 1998.

FIELD OF THE INVENTION

This invention relates to a clip for positioning and holding a vehicle door in an open position.

BACKGROUND OF INVENTION

Generally, in the process of manufacturing a vehicle, the vehicle body and doors are painted simultaneously. This is required to ensure color match between the body and the doors, which could not otherwise be guaranteed if the doors were painted separately. In this manner, the door assemblies are fitted onto the door hinges and positioned in proper vehicle orientation. Subsequently, during the painting process, the door assemblies are repeatedly opened and closed to permit access to all of the surfaces to be painted by the painting equipment. During some of these operations, the vehicle doors must be positioned and retained in the open position. Alternately, other operations require that the vehicle doors be positioned and returned in the closed position. Accordingly, the door assemblies must be equipped with means for releasably positioning and retaining the doors in the open or closed position.

Heretofore, difficulties have been encountered in equipping the door assemblies with a suitable detent mechanism, especially those with separate checks. More particularly, due to the overspray of the paint and other adverse environmental conditions, the production check strap assemblies cannot be utilized. Accordingly, temporary check strap fixtures have been utilized. More particularly, a multiple piece check strap assembly is secured to the door assembly and operably coupled to the vehicle body. The temporary check strap fixture provides a detent for the door assembly between an open and closed position. Upon completion of the painting process, the temporary check strap fixture is uncoupled from the body, the door assemblies are removed from the vehicle body and then the temporary check strap fixture is removed from the door assembly. Since each temporary check strap fixture is fairly costly, they are reconditioned by removing excess paint from the fixture and recycled for use again on other vehicle bodies. Thus, these temporary check strap fixtures are costly in design, in installation, and in maintenance.

Additionally, detent mechanisms have been proposed for particular types of hinges which requires the mechanism to be screwed or fastened to the hinge which has a removable hinge pin as illustrated in U.S. Pat. No. 5,577,295, entitled "Three Diameter Hinge Pin". The screw on type detent mechanism adds considerable cost to the door painting process due to fastener cost and additional labor costs for drilling and tapping a receiving hole in the bracket body and the cost of removal. The use of the screw on type mechanism is thus limited to applications which employ this particular hinge.

SUMMARY OF THE INVENTION

The disadvantages of the prior art may be overcome by providing a vehicle door prop clip which is easily installed without a fastener and is easily removed.

In a major aspect, the invention comprises a vehicle door hinge-mounted prop clip for a vehicle hinge with split pins, comprising first and second interference lobes defining an undulating circumferential edge, said interference lobes being adapted to sequentially releasably contact a position of the hinge as the door is rotated about first and second axial hinge pins from a closed position to an open position, said contact releasably compressing said interference lobes severally or simultaneously and generating sufficient frictional resistance to releasably hold the door in a partially or fully open position.

In a further aspect, the prop clip comprises a cylindrical sleeve body adapted to be mounted on the first hinge pin, a sector shaped flange extending radially from the body, maintenance means to maintain the prop clip in fixed relationship with one portion of a hinge comprising body side and door side portions, and first and second holes in the flange to define a deformation zone for the first and second interference lobes.

In a further aspect, the maintenance means comprises a cut-out portion of the flange adapted to form fit with a link rotatably mounted between the body side and door side portions of the hinge along a common axis of rotation.

In a further aspect, the radial distance between the axis of rotation of the sleeve and the circumferential extent of the first and second interference lobes slightly exceeds the distance between the axis of rotation of the pin, and a bight portion of the body side portion of the hinge, which bight portion the lobes are adapted to contact sequentially or simultaneously.

In a further aspect, the clip is removable from the hinge without removal of either of said first or second hinge pins.

In a further aspect, the clip comprises a flexible thermoplastic material which may be a mineral reinforced nylon resin.

DESCRIPTION OF THE DRAWINGS

In drawings which illustrate the preferred embodiment of the present invention,

FIG. 3 is a top plan view of a door hinge in a closed condition;

FIG. 4 is a top plan view of the door hinge of FIG. 3 in an initial opening position;

DESCRIPTION OF THE INVENTION

Figure 1:
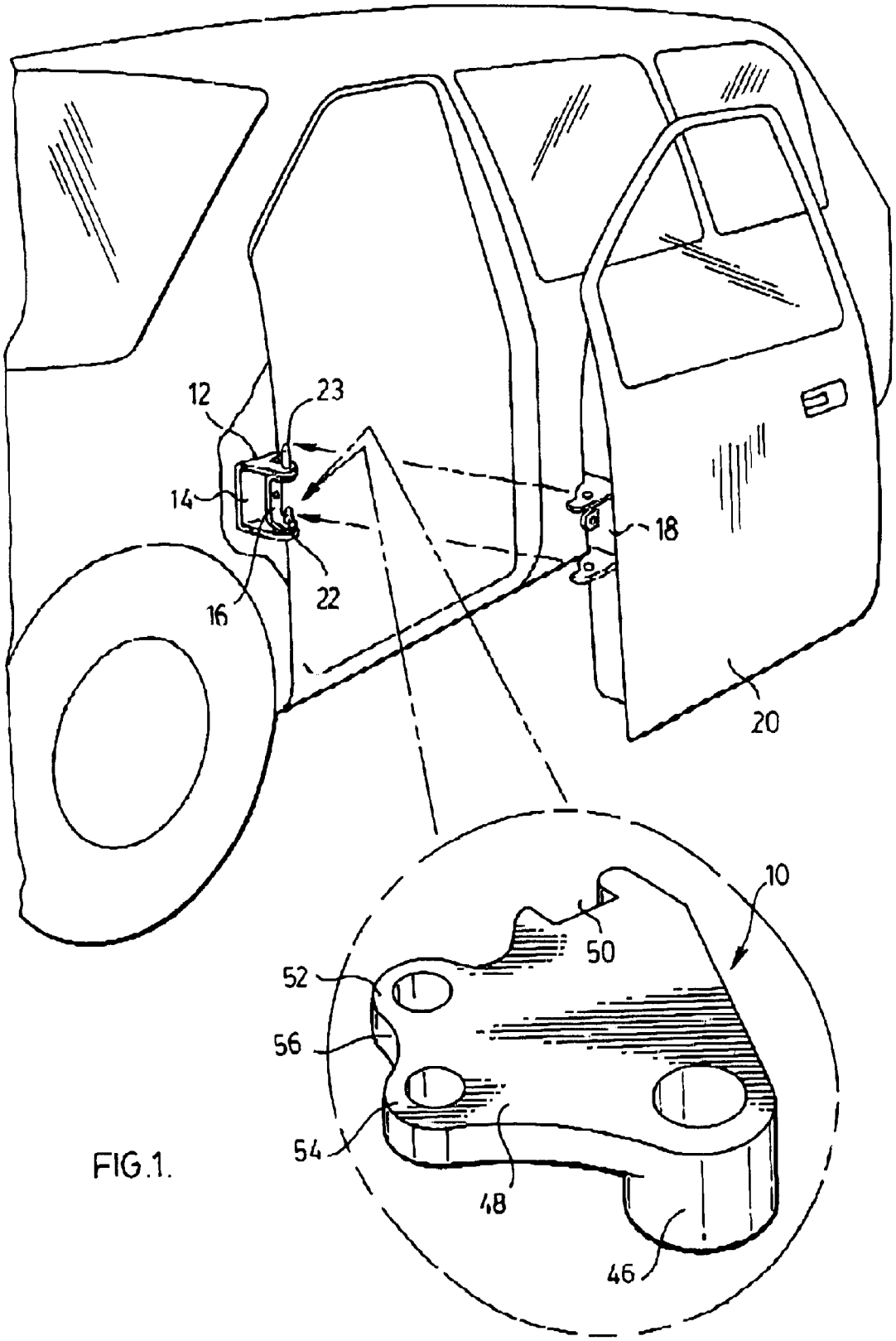
FIG. 1 is a perspective view of a vehicle incorporating a door hinge with a door prop clip of the present invention.

Referring to FIG. 1, there is illustrated a prop clip 10 and a door hinge 12. Door hinge 12 comprises a body bracket 14 and a U-shaped bridge 16 secured to the vehicle and a door bracket 18 secured by bolts to a vehicle door 20. Door bracket 18 is pivotally mounted onto pins 22 and 23 of body bracket 14.

Door hinge 12 is conventional in design and manufacture. Such hinges can be found on a CHEVROLET SILVERADO™.

Figure 2:
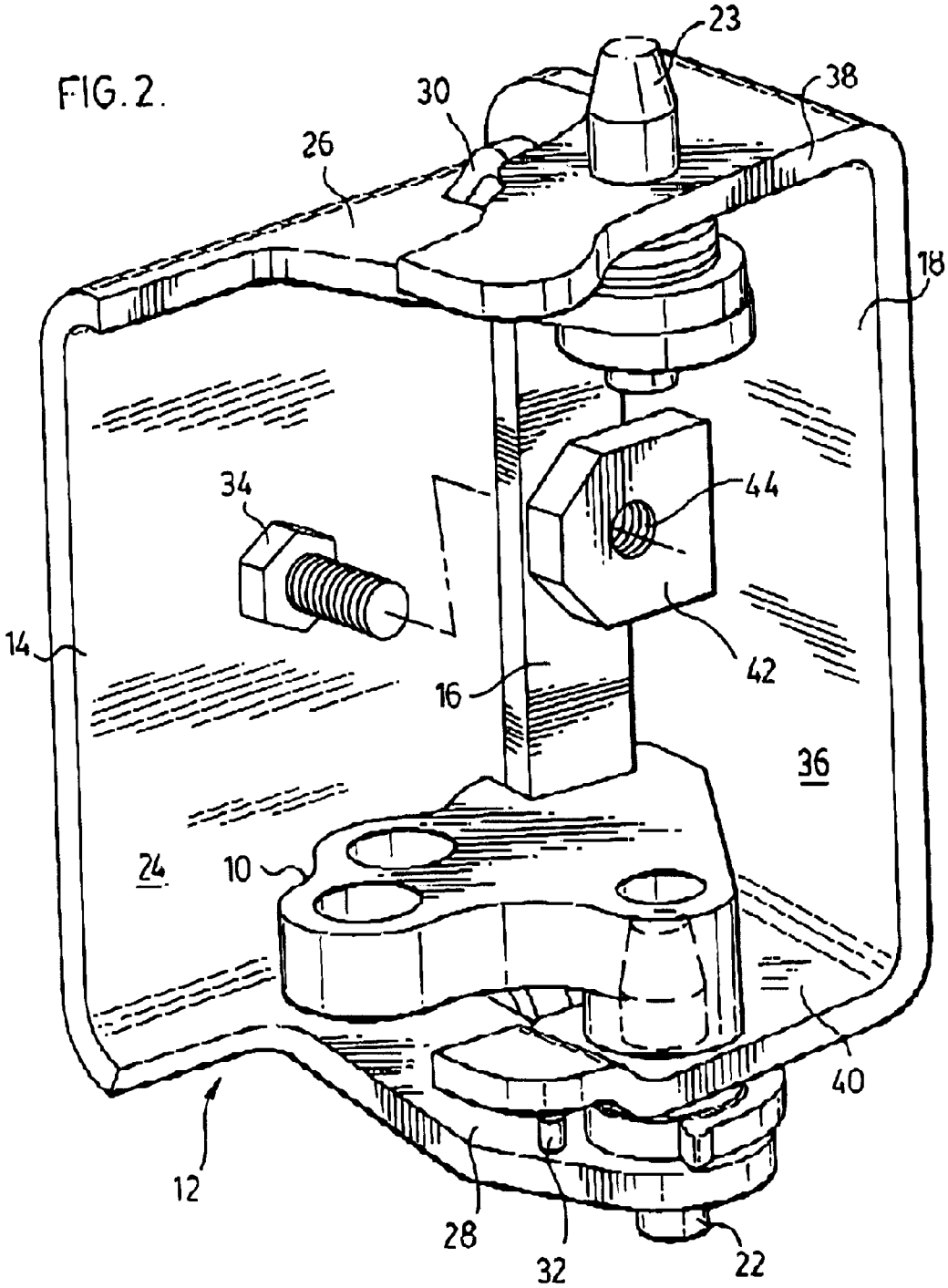
FIG. 2 is a perspective view of a door hinge and prop clip of FIG. 1.

Referring to FIG. 2, body bracket 14 is generally U-shaped having a bight portion 24 and two legs 26, 28 extending therefrom. Legs 26, 28 each have an aperture for mounting pins 23, 22, respectively. Pins 23, 22 extend upwardly. Leg 26 has a formed dimple 30 presenting a stop limit for swing of the hinge 12. Leg 28 has a pin 32 also presenting a stop limit for the U-shaped bridge 16. Body bracket 14 is welded onto the vehicle frame in a manner well known in the art.

Hinge 12 has a U-shaped bridge or side link 16. Side link 16 is configured to fit between legs 26 and 28 and is coaxially mounted on pins 23, 22. The bight portion of link 16 has an aperture for receiving a bolt 34.

Door bracket 18 is generally U-shaped having a bight portion 36 and two legs 38, 40 extending therefrom. Legs 38, 40 are configured to be pivotally mounted over top of pins 22, 23 and have apertures for receiving the pins 22, 23. The distal ends of the legs 38 and 40 are configured to abut with the stops 30 and 32, respectively. The bight portion 36 has a tab 42 having a threaded through bore 44. The threaded bore 44 receives bolt 34 through the link 16 after the door bracket 18 has been mounted on the pins 22, 23 to retain the door 20 on the vehicle. Door bracket 18 is welded onto the vehicle door 20 in a manner well known in the art.

Referring to FIG. 1, the door prop clip 10 has a cylindrical sleeve body 46 having a sector shaped flange 48 radially extending therefrom. The sector flange 48 has a rectangular cut-out 50 and two interference lobes 52 and 54 defining an undulating circumferential edge 56. The radial distance between an axis of rotation of the cylindrical sleeve body 46 and the cut-out 50 is the same as the distance between the axis of rotation of the pins 22, 23 and the link 16 (FIG. 2). Clip 10 is thus configured to mount onto the hinge 12 by the sleeve body 46 mounting onto pin 22 and the cut-out 50 receiving link 16 in a form fit. The radial distance between an axis of rotation of the sleeve 46 and the circumferential extent of the interference lobes 52 and 54 is slightly greater than the distance between the axis of rotation of the pins 22, 23 and the bight portion 24 of vehicle bracket 14. Preferably, the prop clip 10 is made from a mineral reinforced nylon resin, having flex modulus of about 5100 MPa.

Referring to FIG. 3, the door prop clip 10 is mounted on the hinge 12 in the door closed position. The door prop clip 10 is form fitted between the link 16 and pin 22. The sector flange 48 is spaced from the leg 40 of the door bracket 18 in order to minimize the coverage of the clip 10 for painting purposes (FIG. 2).

As the door 20 and the door bracket 18 are opened, bight 24 of body bracket 14 frictionally engages the interference lobe 52 (FIG. 4). Some effort is required to overcome the compressive and frictional forces generated by the clip 10.

Figure 6:
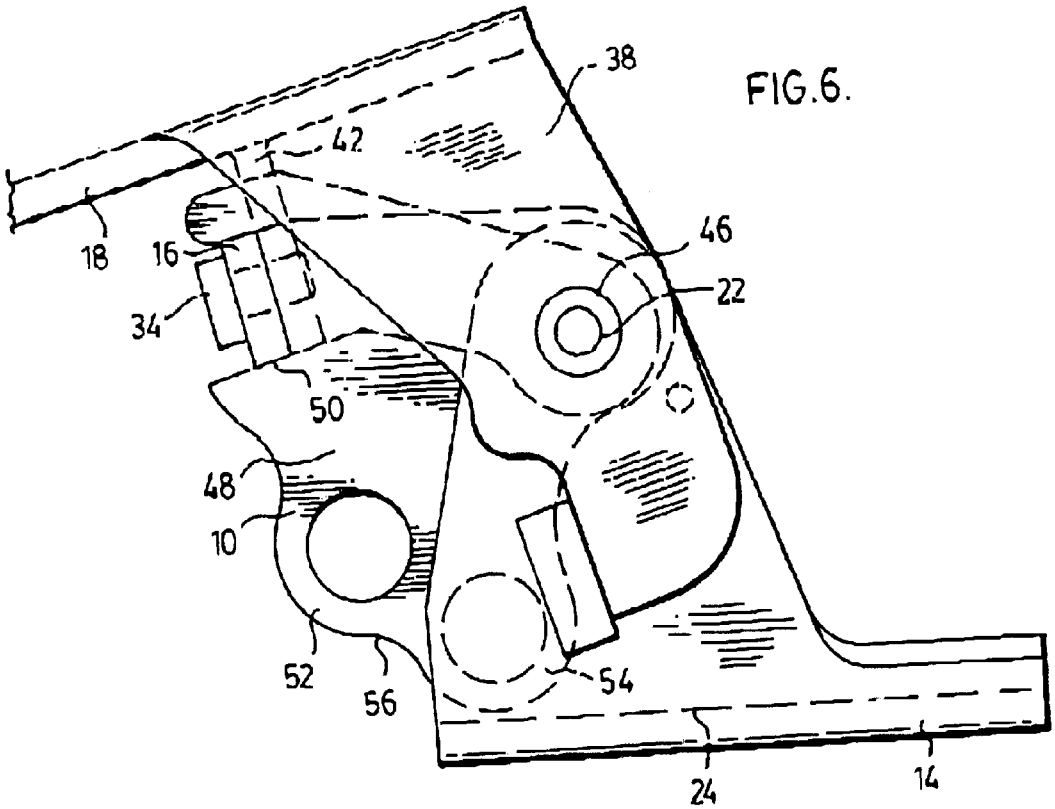
FIG. 6 is a top plan view of the door hinge of FIG. 3 in an open position.
Figure 5:
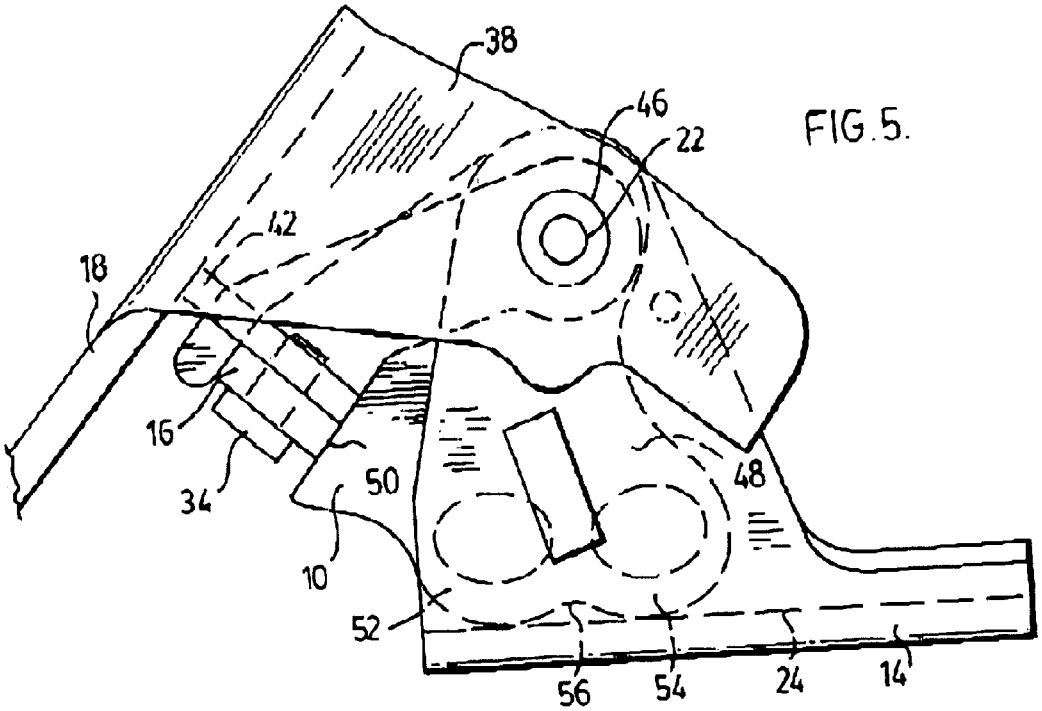
FIG. 5 is a top plan view of the door hinge of FIG. 3 in a mid-open position.

As the door is further opened to the mid-open position (FIG. 5), the bight 24 of body bracket 14 has moved across interference lobe 52 and now engages both interference lobes 52 and 54, which now restricts the movement of the door 20 to maintain the door 20 in the mid-open condition. As the door is further opened (FIG. 6), the bight 24 of body bracket 14 has moved beyond the interference lobe 54, to maintain the door in the fully open position. Interference lobe 54 is not compressed which allows easy removal of the clip 10.

Figure 7:
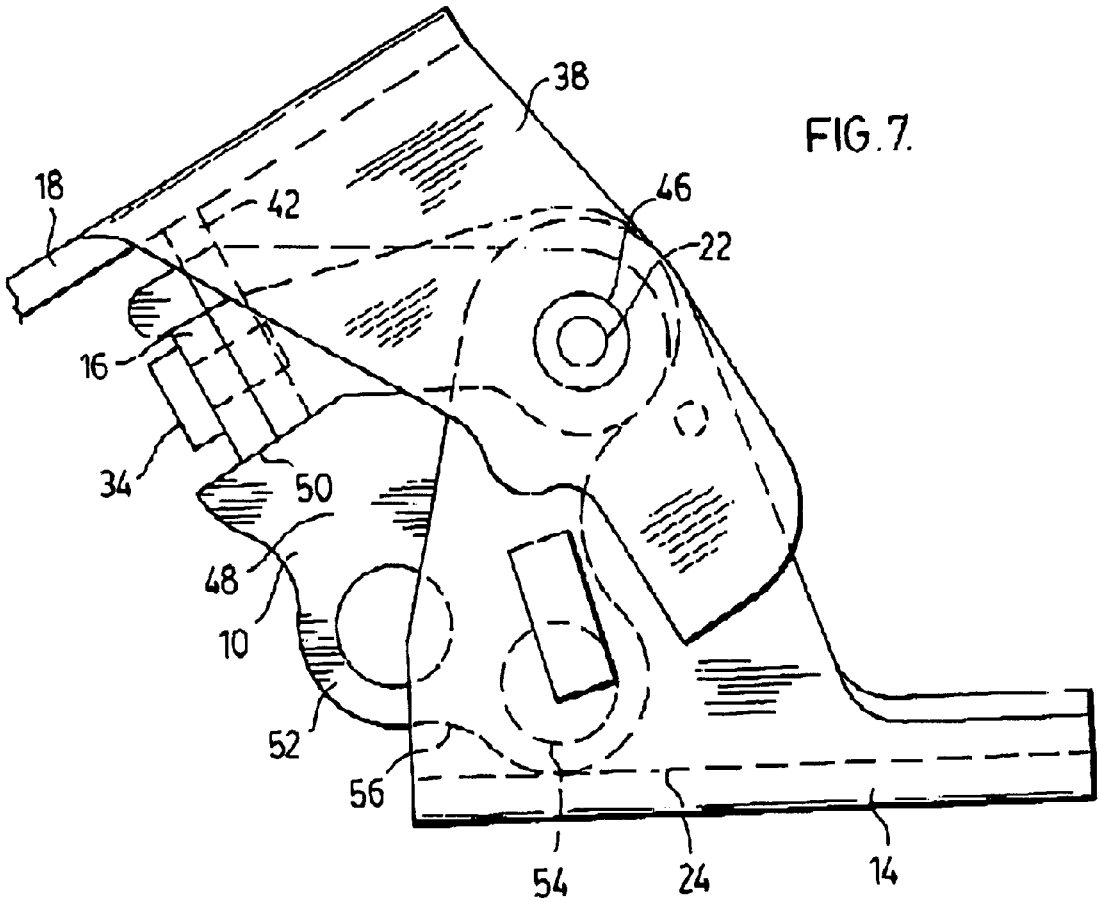
FIG. 7 is a top plan view of the door hinge of FIG. 3 in a painting position.

Referring to FIG. 7, the door is slightly closed to compress interference lobe 54. The compression and frictional forces generated by the interference lobe 54 will hold the door in position for the paint process.

While the present invention has been described in reference to a particular embodiment, one skilled in the art can recognize that certain modifications could be made without departing from the scope of the present invention.

What is claimed is:

1. A vehicle door hinge-mounted prop clip for a vehicle hinge with split pins, comprising first and second interference lobes defining an undulating circumferential edge, said interference lobes being adapted to sequentially releasably contact a portion of the hinge as the door is rotated about first and second axial hinge pins from a closed position to an open position, said contact releasably compressing said interference lobes separately or simultaneously and generating sufficient frictional resistance to releasably hold the door in a partially of fully open position.

2. The prop clip of claim 1, wherein the prop clip comprises:

(a) a cylindrical sleeve body adapted to be mounted on the first hinge pin;

(b) a sector shaped flange extending radially from the body;

(c) maintenance means to maintain the prop clip in fixed relationship with one portion of a hinge comprising body side and door side portions; and (d) first and second holes in the flange to define a deformation zone for the first and second interference lobes.

3. The prop clip of claim 2, wherein the maintenance means comprises a cut-out portion of the flange adapted to form fit with a link rotatably mounted between the body side and door side portions of the hinge along a common axis of rotation.

4. The prop clip of claim 2, wherein the radial distance between an axis of rotation of the sleeve and the circumferential extent of the first and second interference lobes slightly exceeds the distance between the axis of rotation of the hinge pins and a bight portion of the body side portion of the hinge, which bight portion the lobes are adapted to contact sequentially or simultaneously.

5. The prop clip of claim 1, wherein the clip is removable from the hinge without removal of either of said first or second hinge pins.

6. The prop clip of claim 1, wherein the clip comprises a flexible thermoplastic material.

7. The prop clip of claim 1, wherein the clip comprises a mineral reinforced nylon resin.

* * * * *

UNITED STATES PATENT AND TRADEMARK OFFICE

CERTIFICATE OF CORRECTION

PATENT NO. : 6,334,236 B1
DATED : January 1, 2002
INVENTOR(S) : Eric Kalliomaki

It is certified that error appears in the above-identified patent and that said Letters Patent is hereby corrected as shown below:

Column 1,
Line 25, delete the word “returned” and insert -- retained --.

Column 2,
Line 3, delete the word “position” and insert -- portion --.

Column 4,
Line 23, delete the word “of” and insert -- or --.

Signed and Sealed this

Third day of September, 2002

*Attest:*

*Attesting Officer*

JAMES E. ROGAN
*Director of the United States Patent and Trademark Office*